US008428495B2

(12) United States Patent
Li

(10) Patent No.: US 8,428,495 B2
(45) Date of Patent: Apr. 23, 2013

(54) COATINGS FOR LEP PRINTERS, LEP PRINTER STRUCTURES, LEP PRINTERS, AND METHODS OF INHIBITING SLUDGE FORMATION

(75) Inventor: Guang Jin Li, San Diego, CA (US)

(73) Assignee: Hewlett-Packard Developent Company, L.P., Houston, TX (US)

( * ) Notice: Subject to any disclaimer, the term of this patent is extended or adjusted under 35 U.S.C. 154(b) by 1055 days.

(21) Appl. No.: 12/259,582

(22) Filed: Oct. 28, 2008

(65) Prior Publication Data

US 2010/0103437 A1 Apr. 29, 2010

(51) Int. Cl.
*G03G 15/10* (2006.01)

(52) U.S. Cl.
USPC ..... 399/237; 399/233; 399/252

(58) Field of Classification Search ..... 399/237, 399/233, 252
See application file for complete search history.

(56) References Cited

U.S. PATENT DOCUMENTS

| | | | | |
|---|---|---|---|---|
| 4,566,938 | A | 1/1986 | Jenkins et al. | |
| 5,744,241 | A | 4/1998 | Hobson et al. | |
| 6,289,807 | B1 | 9/2001 | Kutzner et al. | |
| 6,477,952 | B1 | 11/2002 | Izume | |
| 7,097,705 | B2 * | 8/2006 | Smith et al. | 106/287.3 |
| 7,156,488 | B2 | 1/2007 | Morris et al. | |
| 7,215,910 | B2 | 5/2007 | Landa et al. | |
| 2001/0051567 | A1 | 12/2001 | Schaschke | |
| 2001/0053296 | A1 * | 12/2001 | Uehara et al. | 399/103 |
| 2002/0068179 | A1 | 6/2002 | Endisch et al. | |
| 2002/0179521 | A1 * | 12/2002 | Paul | 210/457 |
| 2003/0035917 | A1 * | 2/2003 | Hyman | 428/67 |
| 2004/0175206 | A1 | 9/2004 | Landa et al. | |
| 2006/0153597 | A1 * | 7/2006 | Guzman et al. | 399/237 |

FOREIGN PATENT DOCUMENTS

EP 0359365 A1 3/1990

OTHER PUBLICATIONS

DuPont Krytox GPL 106, 206, 216, 226 performance lubricants.*

* cited by examiner

*Primary Examiner* — Walter L Lindsay, Jr.
*Assistant Examiner* — Roy Y Yi

(57) ABSTRACT

Liquid electro-photographic (LEP) printers having a coating disposed thereon, LEP printers having a compound such as fluorosurfactant in the resin to make one or more parts of the LEP printer, and the like, are disclosed.

12 Claims, 5 Drawing Sheets

COATINGS FOR LEP PRINTERS, LEP PRINTER STRUCTURES, LEP PRINTERS, AND METHODS OF INHIBITING SLUDGE FORMATION

BACKGROUND

For liquid electro-photographic (LEP) printers, such as HP Indigo presses, liquid ink (Electrolnk™) contains a colorant that is used to produce color images. In general, LEP printers use a BID (binary ink development) unit to transfer ink onto an organophotoconductor (OPC) drum. One of the reliability issues that limit the usable life of the BID, as well as other components in contact with the ink, is the accumulation of "sludge" (concentrated ink paste) onto one or more surfaces of the BID. In particular, sludge accumulates on walls of the tray or surfaces of other parts in the BID, which causes leaking of the ink from the BID unit and other functional failures. It should also be noted that sludge causes problems in other areas of the LEP printers such as in ink tanks, ink flowing pipes, and other structures that contact the ink. Therefore, a need exists in the art to overcome the problems associated with sludge.

SUMMARY

Briefly described, embodiments of the present disclosure include liquid electro-photographic printers (LEP) including one or more structures (e.g., the inner surface of the tray, the main electrode, and back electrode, and the like) having a repel coating disposed thereon, liquid electro-photographic printers (LEP) including one or more structures (e.g., the inner surface of the tray, the main electrode, and back electrode, and the like) having a release coating disposed thereon, LEP printers including one or more structures made of resins including components that inhibit sludge formation on the structures (e.g., the inner surface of the tray), methods of inhibiting sludge formation on LEP structures, and the like.

One exemplary embodiment of an LEP printer, among others, includes: comprising a structure having a repel coating disposed on a portion of the surface of the structure that contacts an ink formulation, wherein the repel coating is a highly fluorinated compound, wherein the ink formulation is a non-fluorinated ink formulation, and wherein the ink formulation does not substantially accumulate on the surface of the structure.

One exemplary embodiment of an LEP printer, among others, includes: a structure having a release coating disposed on a portion of the surface of the structure that contacts an ink formulation, wherein the release coating is a fluorinated polyurethane, and wherein the ink formulation does not substantially accumulate on the surface of the structure.

One exemplary embodiment of a method of an LEP printer, among others, includes: a structure made of a resin including a fluorosurfactant, wherein the structure contacts an ink formulation, and wherein the ink formulation does not substantially accumulate on the surface of the structure.

BRIEF DESCRIPTION OF THE DRAWINGS

Many aspects of this disclosure can be better understood with reference to the following drawings. The components in the drawings are not necessarily to scale. Moreover, in the drawings, like reference numerals designate corresponding parts throughout the several views.

DETAILED DESCRIPTION

Figure 1:
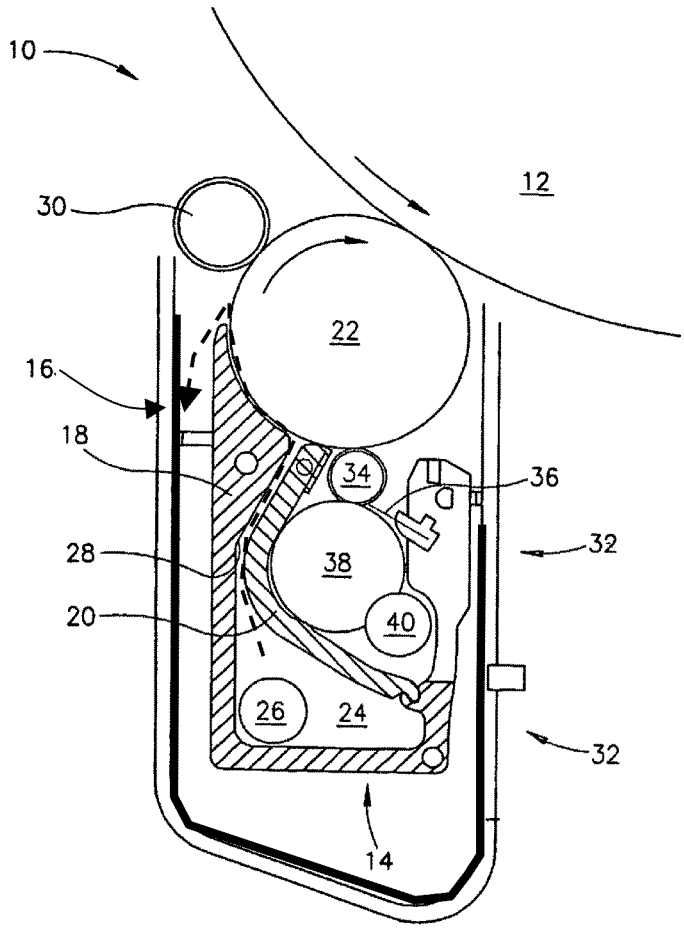
FIG. 1 illustrates a cross-section view of an embodiment of a BID unit. The ink flow path and the regions where "sludge" builds on tray surfaces are also indicated.

Embodiments of the present disclosure will employ, unless otherwise indicated, techniques of synthetic organic chemistry, ink chemistry, electrostatic imaging, and the like, that are within the skill of the art. Such techniques are explained fully in the literature.

The following examples are put forth so as to provide those of ordinary skill in the art with a complete disclosure and description of how to perform the methods and use the compositions disclosed and claimed herein. Efforts have been made to ensure accuracy with respect to numbers (e.g., amounts, temperature, etc.) but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing and test processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an" and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Discussion

Embodiments of the present disclosure include liquid electro-photographic printers (LEP) including one or more structures (e.g., the inner surface of the tray, the main electrode, and back electrode, and the like) having a repel coating disposed thereon, liquid electro-photographic printers (LEP) including one or more structures (e.g., the inner surface of the tray, the main electrode, and back electrode, and the like) having a release coating disposed thereon, LEP printers including one or more structures made of resins including components that inhibit sludge formation on the structures (e.g., the inner surface of the tray), methods of inhibiting sludge formation on LEP structures, and the like.

In short, the following describes a non-limiting embodiment of a LEP printer and operation of the LEP printer. In an embodiment, the electro-photographic printer includes a drum that has a photoconductive surface. When the electro-photographic printer is operated, a drum rotates and a photoconductive surface is charged by a charger (e.g., a corotron, a scorotron, or a roller) to a generally uniform pre-determined voltage. Rotation of the drum brings the charged photoconductive surface into image receiving relationship with an exposure system, such as a light source (e.g., laser beam scanning apparatus). The exposure system forms a desired electrostatic image on the charged photoconductive surface by selectively discharging portions of the photoconductive surface. The image portions are at a first voltage and the background portions are at a second voltage.

Continued rotation of the drum brings the charged photoconductive surface, having the electrostatic image, into operative engagement with a series of binary ink developer units (BIDs) (see FIG. 1). The BIDs are for printing of different colors (Electroink™). The BIDs include components such as, but not limited to, a developer apparatus 14, an ink tray 16 (ink container), an ink inlet 26, a cavity 24, an ink outlet (not shown), a developer roller 22 and structures (e.g., metal core, and conductive rubber) corresponding to the roller, a main electrode 18, a back electrode 20, wiper wall (not shown), splash guards (not shown), a squeegee roller 30, a cleaning system 32 (e.g., a wiper 36, a cleaning roller 34, a sponge roller 38 (and structures (e.g., a metal core and a sponge) corresponding to the roller), a squeezer roller 40), and endcaps (not shown). Ink is circulated into a BID unit 10 from a separate ink tank through piping, which includes the ink container (and structures of the corresponding to the roller), and ink controlling system (including ink pump, filter, ink conductivity and density monitoring mechanisms).

Figure 2:
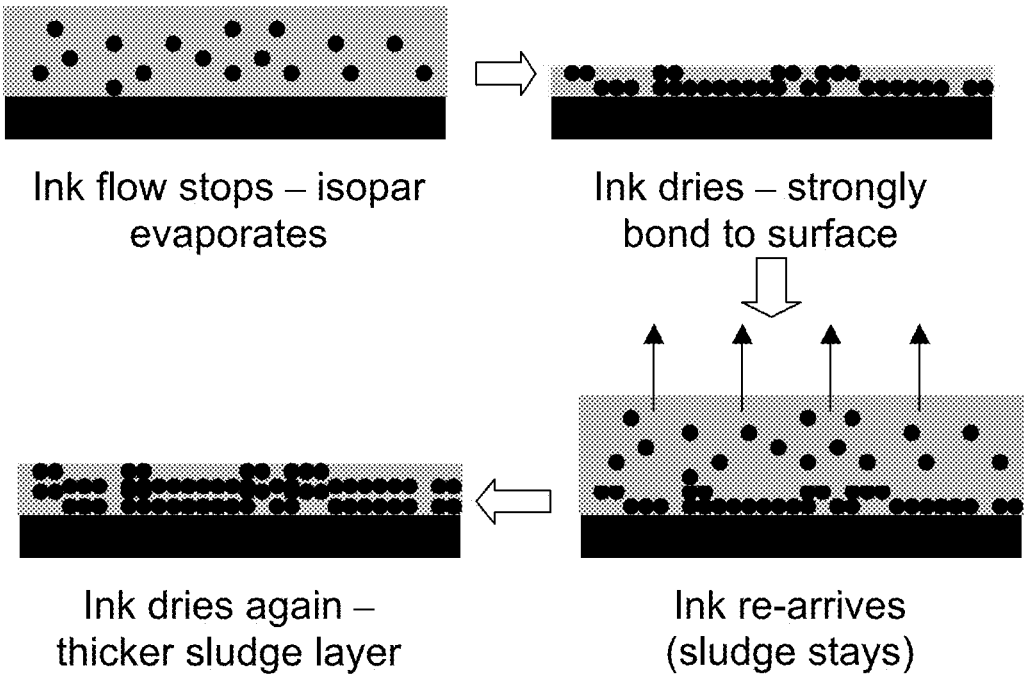
FIG. 2 illustrates one of the mechanisms of sludge formation with ink dry cycle, where "sludge" accumulates on a fresh surface with "wet-dry" cycles.

Referring to FIG. 1, FIG. 1 illustrates a cross-section view of a LEP binary ink development (BID) unit. Reference numerals in FIG. 1 correspond to the reference numerals in the text describing FIG. 1. In FIG. 1 liquid electroink can be introduced into the unit through an inlet 26 and travels upwards through the gap between main electrode 18 and the back electrode 20. When passing through the small gap between the main electrode 18 and the developer roller 22, some electrical charged toner particles are developed onto the surface of developer roller 22 and later on transfers to a photoreceptor of 12. Most of the charged toners and carrier liquids flow back to the system through the gap between the tray 16 and backside of the main electrode 18. Sludge can be built up on any surfaces that contact toner particles, especially those parts that are not moving. For example, most parts of the inner surface of the tray 16 and surface of main electrode 18 and the back electrode 20 are susceptible to sludge accumulation. FIG. 2 illustrates one of the mechanisms of sludge formation with the ink dry cycle, where "sludge" accumulates on a fresh surface with "wet-dry" cycles.

One or more of the BID components are made of a plastic material. For example, an ink tray, developer rollers, splash guards, or endcaps, could be made of plastic materials. The ink pipes, the ink tank, the ink filter, and some other components in the ink controlling system could also be made of plastic as well. The term "plastic" refers to a composition including binder (compounds having a polymer backbone), fillers, and other components. For example, the term plastic refers to thermoplastic, thermoset plastics, and the like.

In general, the surfaces of the developer rollers of the BIDs are coated with a very thin layer of concentrated liquid ink (or an ink formulation), or toner through electric field development. When surfaces of developer rollers having the layer of liquid toner concentrate thereon are engaged with photoconductive surface of the drum, the difference in voltage between each developer roller and the photoconductive surface causes the selective transfer of the layer of toner particles to the photoconductive surface. This causes the desired electrostatic image to be developed on the photoconductive surface.

The electrostatic image developed is transferred to the desired substrate via an intermediate transfer member in operative engagement with the photoconductive surface of the drum having the developed image. The substrate is urged against the intermediate transfer member. The transfer of the developed image from intermediate transfer member to the substrate is a thermal transfer and based on the affinity of the ink to the substrate versus the affinity to the blanket. The transfer could be assisted electrostatically.

The substrate can include, but is not limited to, coated paper, un-coated paper, polymer based synthetic paper (e.g., Tyvex), label stock, polymer stock (e.g., polyethylene, polypropylene, polyester, PVC, and polycarbonate). The substrate can have a wide range of weights as well, without requiring any adjustment to the LEP printer.

As evident from the description above, ink comes into contact with numerous components and/or could be deposited (by design or by accident) onto numerous components during printing. Thus, embodiments of the present disclosure can be used in reference to one or more structures that come into contact with the ink, which could form into sludge on the surface of the structure.

The term "sludge" refers to the build up of concentrated ink or dried ink on a surface of a structure in a LEP printer. As mentioned above, when sludge forms on LEP printer structures, the sludge can cause leaks to form and/or other functional failures. Embodiments of the present disclosure inhibit the formation of sludge on LEP printer structures. Therefore, LEP printer structures have a longer operating life and require less maintenance. As a result, LEP printers can operate more efficiently and cost effectively than other LEP printers not using embodiments of the present disclosure.

The LEP printer structures can include, but are not limited to, plastic and metal structures. The LEP printer structures can include the BID components listed above. In addition, the LEP printer structures can include, but are not limited to, ink flow piping, the ink tank, the ink filter, the ink pump, the ink property monitoring components, and the like. The plastic structures include, but are not limited to, the BID tray, the splash guards, the end caps, the ink flow piping, the ink tank, the ink filter, and the like.

In an embodiment, either a repel coating or a release coating is disposed on a surface or the entire surface of one or more LEP printer structures (e.g., BID structures such as the ink tray and the like). In an embodiment, one or more structures of the LEP printer structure could have a repel coating, while one or more other structures of the LEP printer structure could have a release coating. Either of the release coating or the repel coating can be disposed on the surface of the structure by methods such as, but not limited to, dipping the structure in the coating, pouring the coating on the structure, spraying the coating on the structure, and combinations thereof.

In an embodiment, disposing the repel coating onto one or more of the surfaces of the LEP structure substantially prevents (reduces by about 80% when compared to components not including the repel coating) or prevents the formation of sludge on the coated surface. In particular, the repel coating repels ink (e.g., Electroink™) from the surface of the LEP printer structure upon which the repel coating is applied. The repel coating prevents the ink from wetting the surface of the structure because of the low surface energy of the repel coating. Thus, dried ink can not substantially accumulate or accumulate on the surface of the structure.

In an embodiment of the repel coating, the repel coating produces superior results as compared to not using a repel coating when the repel coating is used in conjunction with ink formulations that do not include fluorinated materials in the ink formulation (referred to as a "non-fluorinated ink" or "non-fluorinated ink formulation"). In an embodiment, the fluorinated materials can include materials such as PTFE (polytetrafluoroethene), PFA (perfluoroalkoxyethylene), ETFE (ethylene-tetrafluoroethylene copolymer), FEP (tetrafluoroethylene-hexafluoropropylene copolymer), PVDF (polyvinylidene fluoride), ECTFE (ethylene-chlorotrifluoroethylene copolymer), and combinations thereof. The term "non-fluorinated ink" includes ink formulations that do not include fluorinated materials in the formulation such as those mentioned above.

The repel coating includes highly fluorinated compounds such as highly fluorinated polymeric materials. The term "highly fluorinated compound" can refer to organic compounds where C—H bonding is replaced by C—F bonding. In particular, highly fluorinated compound refers to compounds with most of its C—H groups replaced by C—F groups (greater than 50% substitution). In an embodiment, highly fluorinated compound refers to those compounds that end with $CF_3$—$(CF_2)_x$—, where x is 1 to 50. In an embodiment, the highly fluorinated polymeric material has a low surface energy (e.g., less than 20 dynes/cm). In an embodiment, the highly fluorinated polymeric materials can include, but are not limited to, fluoroalkyl polymers, perfluoropolyether (PFPE), fluorinated epoxy, fluorinated urethane, fluorinated acrylic, fluorinated silicone and other fluorinated polymeric materials (Fluoropel®), and combinations thereof.

The fluoroalkyl polymer includes compounds such as, but not limited to, polytetrafluoroethylene (PTFE), polyvinyl fluoride (PVF), polyvinylidene fluoride (PVDF), polychlorotrifluoroethylene, hexafluoropropylene (HFP), and copolymers of each of these compounds.

The perfluoropolyether (PFPE) includes compounds such as, but not limited to, perfluoropropylvinylether (PPVE) and perfluoromethylvinylether (PMVE).

The fluorinated epoxy includes epoxy compounds including fluorinated segments within the structures such as, but not limited to, 1,1-Bis(4-glycidylesterphenyl)-1-(3'-trifluoromethylphenyl)-2,2,2-trifluoroethane (BGTF), and the like.

Polyurethanes are a product of polyol and isocyanate. The fluorinated urethane can be made from either fluorinated polyol, fluorinated isocyanate, or both. The fluorinated polyol includes compounds such as, but not limited to, hexafluoropentanediol and tetrafluoro-p-hydroquinon. The fluorinated isocyanate includes compounds such as, but not limited to, perfluorotrimethylene diisocyanate, hexafluoropentamethylene diisocyanate, perfluoroglutaryl diisocyanate, tetrafluoro-p-phenylene diisocyanate, and tetrafluoro-m-phenylene.

The fluorinated acrylic includes compounds such as, but not limited to, polyfluoroalkyl acrylate such as poly-1,1-dihydroperfluoroheptyl acrylate, 2,2,2-trifluoroethyl methacrylate, and 2-(perfluorobutyl)ethyl methacrylate.

The fluorinated silicone includes compounds such as, but not limited to, polymethyltrifluoropropylsiloxane, polymethylnonafluorohexylsiloxane, and polyheptadecafluorodecylmethylsiloxane.

In addition, the repel coating can include other components such as, but not limited to, fluorocarbons, hydrofluorocarbons, epoxies, cross-linkers (such as amines), and combinations thereof.

The highly fluorinated polymeric materials can be about 0.1 to 20% weight of the repel coating. In another embodiment, the highly fluorinated polymeric materials can be about 0.5 to 5% weight of the repel coating. In another embodiment, the highly fluorinated polymeric materials can be about 1 to 3% weight of the repel coating.

In an embodiment, disposing the release coating onto one or more of the surfaces of the LEP structure substantially reduces (reduces by about 60% to 70% or more when compared to components not including the release coating disposed thereon) or prevents the formation of sludge on the coated surface. In particular, the release coating has a poor adhesion for the inks (Electroink™) used in the LEP printer so that the ink easily washes off the surface or a layer of dried ink. Thus, dried ink can not substantially accumulate or accumulate on the surface of the structure. It should be noted that superior results can be obtained using inks including fluorinated materials (e.g., PTFE) or with ink not including fluorinated materials.

The release coating includes compounds such as fluorinated polyurethanes, which are formed by reacting a fluorinated polyol and polyisocyanate. In an embodiment, the fluorinated polyurethane can include, but is not limited to, an aliphatic fluorinated polyol and an isocyanate and other additives. An aliphatic fluorinated polyol refers to an aliphatic compound having one or more hydroxy-functional groups, with fluorine atoms attached to one or more carbon atoms. The aliphatic, fluorinated hydroxy-functional compounds can be either monomeric (low molecular weight) or polymeric. The degree of fluorination of the aliphatic, fluorinated polyol can vary such that both partially fluorinated and perfluorinated aliphatic hydroxy-functional compounds are suitable for use in the practice of the embodiments of the present disclosure. Examples of aliphatic, fluorinated polyols include fluoroalkane alcohols, fluoroether alcohols, and fluoro-sulfonamide alcohols.

Isocyanate reacts with polyol to form cross-linked polymer matrix-polyurethane. Examples of isocyanate include linear, branched, and cyclic aliphatic compounds containing two or more isocyanate groups, such as, 4,4'-methylene-bis-(cyclohexyl isocyanate), 1,4-cyclohexane diisocyanate, 1,3-cyclohexane diisocyanate, 1,4-butane diisocyanate, 1,6-hexane diisocyanate, 1,10-decane diisocyanate, 2,2,4-trimethyl-1,6-hexane diisocyanate, bis-(3-methyl-4-isocyanato-cyclohexyl)methane, 2,2-bis-(4-isocyanatocyclohexyl) propane, 3-isocyanatomethyl-3,5,5-trimethylcyclohexylisocyanate, 4,4'-dicyclohexyl diisocyanate, and 2,4'-dicyclohexyl diisocyanate.

In an embodiment, the release coating can include one or more components to assist in the coating of the release coating using techniques such as, but not limited to, spraying, dipping, flow coating, and the like. The other components can be used to control viscosity, drying, curing, and the like of the release coating. In this regard, the release coating can include other components such as, but not limited to, acetone, ethyl acetate, silicate, and combinations thereof. The other components can be about 0.1 to 60% weight of the release coating. The amount of the other components used can vary depending upon the requirements of the structure and the system.

The term "disposed" as used in this disclosure as it relates to either of the repel coating or release coating means a physical and/or chemical interaction (e.g., bond, bonded, bound, absorbed, and the like) in which the one or more components of the repel coating or release coating is adsorbed and/or bonded on the structure surface. As mentioned above, the coatings can be disposed using methods known in the art.

In another embodiment, one or more compounds can be incorporated into the resins used to form the plastic structures of the LEP printer noted above. The resin used to form the plastic structure includes, but is not limited to, polycarbonate, PBT (polybutylene terephthalate) plastic material, polyetherlmide (PEI), and polysulfone. In addition, a fluorosurfactant is added to the resin. The fluorosurfactant can include, but is not limited to, non-ionic fluorosurfactants, anionic fluorosurfactants and cationic fluorosurfactants. Non-ionic fluorosurfactant refers to fluorine containing surfactants that don't dissociate in water or solvents. Examples of non-ionic fluorosurfactants include fluorine-substituted oxyethylated alcohols, fluorinated polyhydric alcohols, and fluorinated amines. Anionic fluorinated surfactants dissociate in water or a solvent to form a surface-active ion with an oppositely charged counter ion. The anionic fluorosurfactants can include carboxylates, sulfonates, sulfates and phosphates. In particular, the anionic fluorosurfactant can include, but is not limited to, perfluoroalkanesulfonic acids and salts, tetraethylammonium perfluorooctanesulfonate, and oxyethylenesulfonates. In an embodiment, the fluorosurfactant can be about 0.01% to 5% weight of the resin. In another embodiment, the fluorosurfactant can be about 0.1 to 1.0% weight of the resin.

The resin can be molded or otherwise formed into the plastic structures of the LEP printer using known techniques. The plastic structures that could be produced using the resin, including the fluorosurfactants, include all of the structures noted above in reference to the LEP printer.

Although not intending to be bound by theory, it should be noted that the fluorosurfactant migrates to the surface of the plastic structure of the LEP printer to significantly lower the surface energy, which helps to inhibit the formation of the sludge on the surface of the plastic structure. In the preferred case, the fluorinated surfactants react with other components during the cross-linking process, to participate in the polymer matrix, which greatly improves the robustness of the surface property.

The following illustrative paragraphs generally describe electrostatic inks. In general, toner compositions, in particular, electrostatic toner compositions formulations (also referred to as "electrostatic ink" or "ink formulations") include a carrier liquid and a resin. In addition, the ink formulation may include one or more of the following: a colorant, a charge adjuvant, a charge director, a surface modifier, compatibility additives, charging additives, transfer additives, and other additives.

The carrier liquid can include, but is not limited to, an insulating, nonpolar liquid that is used as the medium for toner particles. The carrier liquid can include compounds that have a resistivity in excess of about $10^9$ ohm-cm and a dielectric constant below about 3.0. The carrier liquid can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof.

Embodiments of the carrier liquids include, but are not limited to, aliphatic hydrocarbon, isoparaffinic compounds, paraffinic compounds, dearomatized hydrocarbon compounds, and the like. In particular, the carrier liquids can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, and Purogen HF (100% synthetic terpenes) (sold by ECOLINK). The carrier liquids and other components of the present disclosure are described in U.S. Pat. Nos. 6,337,168, 6,070,042, and 5,192,638.

In an embodiment, the carrier liquid can be about 20 to 95% by weight of the toner composition. In another embodiment, the carrier liquid can be about 40 to 90% by weight of the toner composition. In another embodiment, the carrier liquid can be about 60 to 80% by weight of the toner composition.

The resin can include, but is not limited to, thermoplastic toner resins. In particular, the resin can include, but is not limited to, ethylene acrylic acid copolymers; methacrylic acid copolymers; ethylene vinyl acetate copolymers; copolymers of ethylene (80% to 99.9%), acrylic, or methacrylic acid (0.1% to 20.0%)/alkyl (C1 to C5) ester of methacrylic or acrylic acid (0.1% to 20%); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g., copolymer of acrylic or methacrylic acid and at least one alkyl ester of acrylic or methacrylic acid wherein alkyl is 1 to about 20 carbon atoms, such as methyl methacrylate (50% to 90%)/methacrylic acid (0% to 20%)/ethylhexylacrylate (10% to 50%)); ethylene-acrylate terpolymers: ethylene-acrylic esters-maleic anhydride (MAH) or glycidyl methacrylate (GMA) terpolymers; low molecular weight ethylene-acrylic acid ionomers and combinations thereof. In an embodiment, the resin can be about 5 to 80% by weight of the toner composition. In another embodiment, the resin can be about 10 to 60% by weight of the toner composition. In another embodiment, the resin can be about 15 to 40% by weight of the toner composition.

In an embodiment, the resin can include the Nucrel family of toners (e.g., Nucrel 403™, Nucrel 407™, Nucrel 609HS™, Nucrel 908HS™, Nucrel 1202HC™, Nucrel 30707™, Nucrel 1214™, Nucrel 903™, Nucrel 3990™, Nucrel 910™, Nucrel 925™, Nucrel 699™, Nucrel 599™, Nucrel 960™, Nucrel RX 76™, Nucrel 2806™, Bynell 2002, Bynell 2014, and Bynell 2020 (sold by E. I. du PONT)), the Aclyn family of toners (e.g. Aaclyn 201, Aclyn 246, Aclyn 285, and Aclyn 295), and the Lotader family of toners (e.g. Lotader 2210, Lotader, 3430, and Lotader 8200 (sold by Arkema)).

In an embodiment, the toner composition can include a colorant. The colorants can include organic and/or inorganic colorants. The colorant can be a dye or pigment. The colorants can include, but are not limited to, cyan colorants, magenta colorants, yellow colorants, violet colorants, orange colorants, green colorants, black colorants, and combinations thereof.

Colorants used in conjunction with Electrolnk® based systems are known in the art. In particular, the colorant and resin are mixed to form a colored polymer particle. In an embodiment, the colorant is a cyan colorant, a violet colorant, a green colorant, or a black colorant. In particular, the colorant is a cyan colorant or a black colorant. In an embodiment, the colorant is a cyan colorant. The colorant can be about 0.1% to 80% by weight of the toner composition.

In an embodiment, the toner composition can include a charge adjuvant. The charge adjuvant can include, but is not limited to, barium petronate, calcium petronate, Co salts of naphthenic acid, Ca salts of naphthenic acid, Cu salts of naphthenic acid, Mn salts of naphthenic acid, Ni salts of naphthenic acid, Zn salts of naphthenic acid, Fe salts of naphthenic acid, Ba salts of stearic acid, Co salts of stearic acid, Pb salts of stearic acid, Zn salts of stearic acid, Al salts of stearic acid, Cu salts of stearic acid, Fe salts of stearic acid, metal carboxylates (e.g., Al tristearate, Al octanoate, Li heptanoate, Fe stearate, Fe distearate, Ba stearate, Cr stearate, Mg octanoate, Ca stearate, Fe naphthenate, Zn naphthenate, Mn heptanoate, Zn heptanoate, Ba octanoate, Al octanoate, Co octanoate, Mn octanoate, and Zn octanoate), Co lineolates, Mn lineolates, Pb lineolates, Zn lineolates, Ca oleates, Co oleates, Zn palmirate, Ca resinates, Co resinates, Mn resinates, Pb resinates, Zn resinates, AB diblock copolymers of 2-ethylhexyl methacrylate-co-methacrylic acid calcium, and ammonium salts, copolymers of an alkyl acrylamidoglycolate alkyl ether (e.g., methyl acrylamidoglycolate methyl ether-co-vinyl acetate), and hydroxy bis(3,5-di-tert-butyl salicylic) aluminate monohydrate. In an embodiment, the charge adjuvant is aluminum tristearate. In an embodiment, the charge adjuvant can be about 0.1 to 5% by weight of the toner composition. In another embodiment, the charge adjuvant can be about 0.5 to 4% by weight of the toner composition. In another embodiment, the charge adjuvant can be about 1 to 3% by weight of the toner composition.

The charge director can include, but is not limited to, lecithin, oil-soluble petroleum sulfonates (e.g., neutral Calcium Petronate™, neutral Barium Petronate™, and basic Barium Petronate™), polybutylene succinimides (e.g., OLOA™ 1200 and Amoco 575), and glyceride salts (e.g., sodium salts of phosphated mono- and diglycerides with unsaturated and saturated acid substituents), sulfonic acid salts including, but not limited to, barium, sodium, calcium, and aluminum salts of sulfonic acid. The sulfonic acids can include, but are not limited to, alkyl sulfonic acids, aryl sulfonic acids, and sulfonic acids of alkyl succinates (e.g., See, WO 2007/130069). In an embodiment, the charge director can be about 0.001 to 1% by weight of the toner composition. In another embodiment, the charge director can be about 0.001 to 0.15% by weight of the toner composition.

While embodiments of the present disclosure are described in connection with Examples and the corresponding text and figures, there is no intent to limit the disclosure to the embodiments in these descriptions. On the contrary, the intent is to cover alternatives, modifications, and equivalents included within the spirit and scope of embodiments of the present disclosure.

EXAMPLE 1

Testing with Repel Coating

FluoroPel® (which can be purchased from Cytonix Corporation) coating PFC-510A-coe20 was applied onto Ultem coupons by dipping (or spraying). The coating was cured at 45-120° C. for 10-30 minutes. The anti-sludge performances of the coated samples were evaluated with a dipping method using an ink without any fluorinated components.

Figure 3:
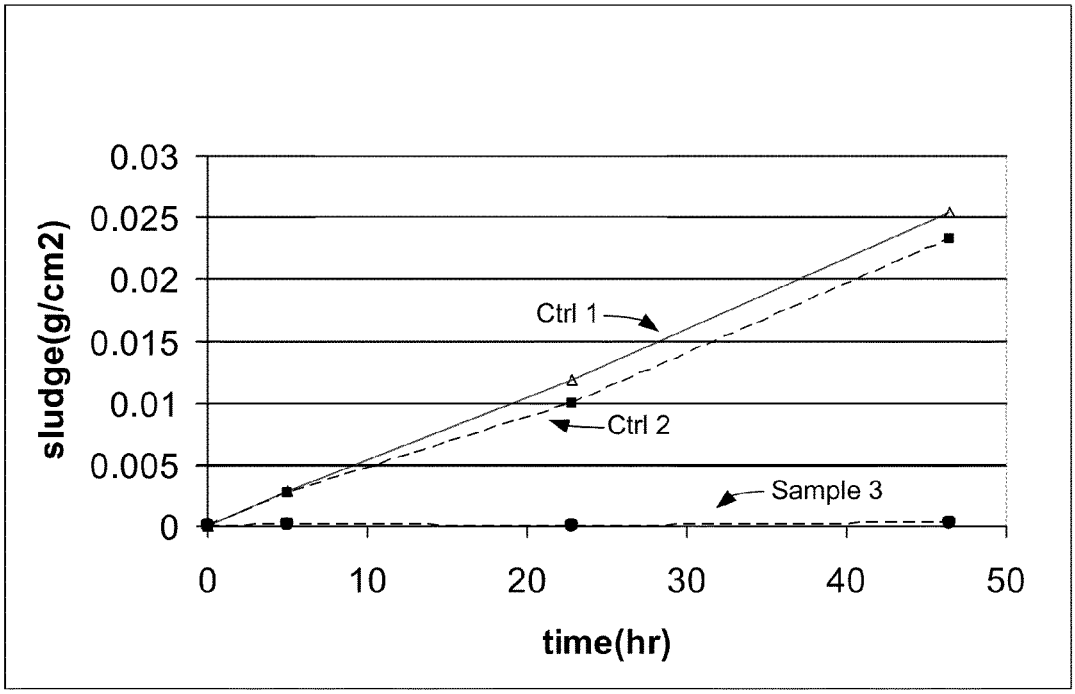
FIG. 3 is a graph that illustrates the rate of sludge built-up on Ultem coupons coated with an embodiment of a repel coating (sample 3) of the present disclosure and uncoated samples (Ctrl 1 and Ctrl 2) with a 4% solid content ink having no fluorinated components in the ink formulation.

FIG. 3 illustrates the rate of sludge built-up on Ultem coupons coated with a repel coating (sample 3) and uncoated samples (Ctrl 1 and Ctrl 2) with a 4% solid content ink having no fluorinated compounds in the ink formulation.

The results are shown in FIG. 3, where no sludge is formed for more than 50 hours (ink did not wet the coating surface as shown in picture B) on the coated samples, while the uncoated samples showed the formation of a lot of sludge.

EXAMPLE 2

The samples in example 1 were tested with an electrostatic ink that included fluorinated components. The results showed that a lot of sludge accumulated on both coated and un-coated samples. Although not intending to be bound by theory, a possible reason why the repel coating is not effective with electrostatic inks having fluorinated components may be due to the hydrophobic attraction between coated surface and fluorinated components in the ink system.

EXAMPLE 3

Release coating—anti-sludge performance of Ultem tray materials are compared with a release coating coated coupons. The release coating is a fluorinated polyurethane release coating.

In this example, coated and uncoated Ultem coupons were compared based on their sludge performance. Ultem coupons having dimensions of 100 mm×20 mm were cut from BID trays, and some of them were coated with release coating (which can be purchased 21$^{st}$ Century Coatings Ltd.). The coating was applied onto the Ultem coupon surface by dipping and the coupon was cured at 60° C. at 75% RH for 16 hours.

Uncoated Ultem coupons and release coating coated Ultem coupons were tested with a dipping test tool, where coupons were dipped with cycles, where the cycles were: in ink for 10 minutes and then allowed to dry for 20 mins to 150 hours.

Figure 4:
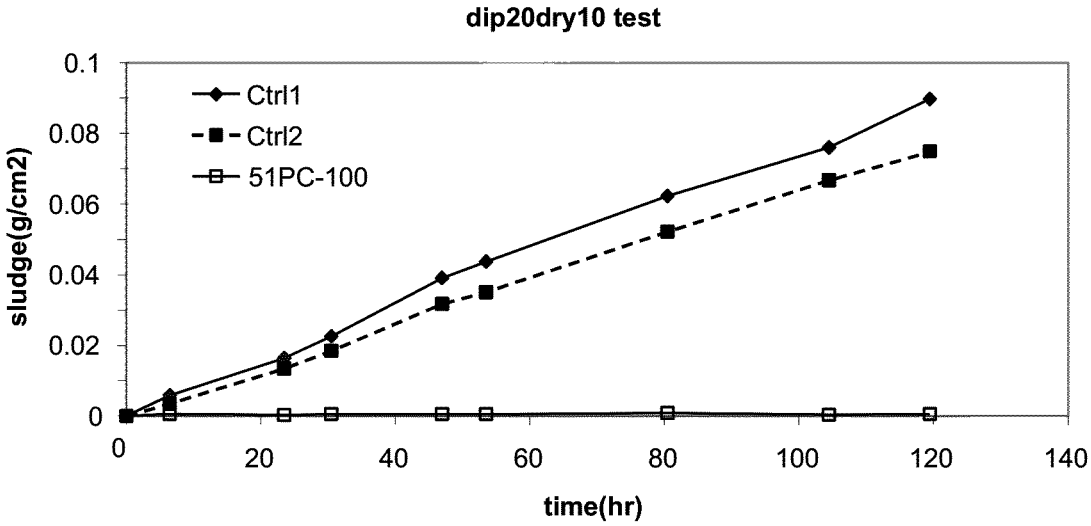
FIG. 4 is a graph illustrating the sludge accumulation rate with testing time for an embodiment of a release coated sample of the present disclosure and control samples (no coating).

FIG. 4 is a graph illustrating the sludge accumulation rate with testing time for an embodiment of a release coated sample and control (not coated) samples.

Figure 5:
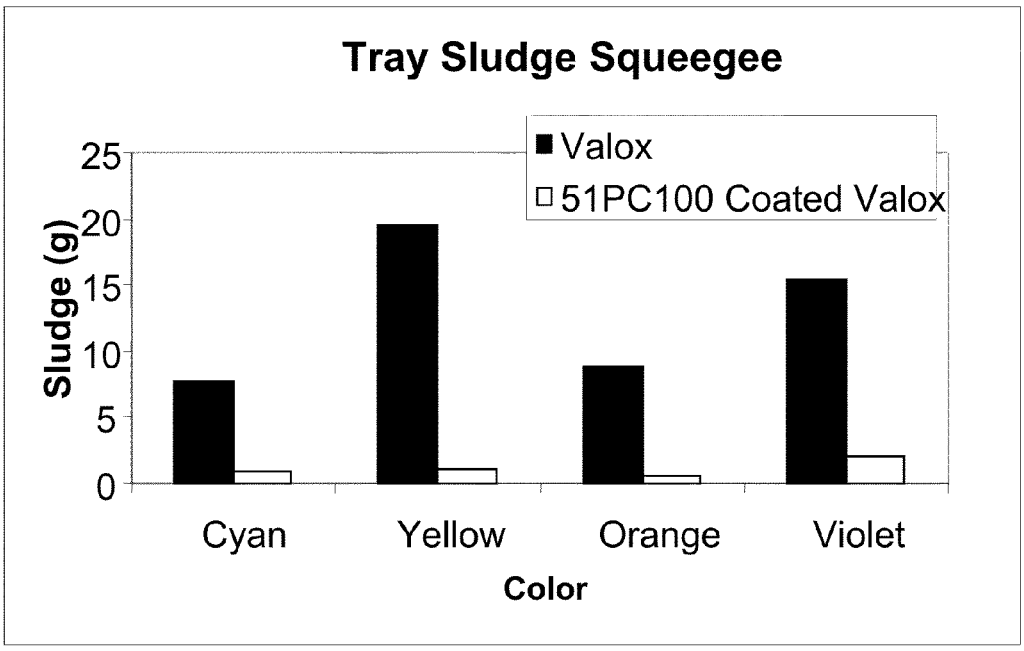
FIG. 5 is a graph illustrating the sludge testing results of embodiments of an Indigo™ press with Valox™ tray and embodiments of release coating (51Pc100) coated trays of the present disclosure, after testing for more than 400 k.

As shown in FIG. 5, very thick sludge was built on naked Ultem coupons, while no sludge on coated Ultem coupons.

EXAMPLE 4

Release Coating

Effect of Curing Humidity of the Coating on the Sludge Performance

There are two samples, A and B, both were Ultem coupons coated with the release coating. Sample A was cured at 60° C. and relative humidity (RH) of 90% for 16 hours, while sample B was cured at 60° C. and 20% RH for 16 hours. The sludge dipping test at 26 hours showed that sample A had no sludge, while sample B showed a lot of sludge accumulation.

It can be concluded that humidity for coating curing affects sludge buildup, where higher humidity favors the release property of the coating.

Further analysis and testing proved that the coating (polyurethane) is not able to be cured completely without the help of humidity, because of the loss of mobility of active components with solidifying of the coating material.

Another curing condition recommended for this coating was found to be as follows: Cure at 50-60° C. for 20-40 mins—followed by disposing the samples at room temperature (20-30° C.) with high humidity for 5-7 days.

EXAMPLE 5

Release Coating on Press (Indigo™ LEP Printer) Testing

In this example, two groups of BID units were built with trays made of Valox® (PBT—Polybutylene Terephthalate plastic material, Valox® (GE Plastics)) and Valox® coated with the release coating. Both groups of BID units were tested with Indigo™ LEP printers for prolonged periods to over 400,000 impressions. One impression refers to a page printing for one BID unit. After the test was finished, all BID units were disassembled, and the amount of sludge on the tray surface was collected and weighed.

FIG. 5 is a graph illustrating the sludge testing results on embodiments of an Indigo™ press with Valox tray and release coating coated trays, after testing for more than 400 k impressions. The data is shown in FIG. 5, where significant improvements of sludge accumulation were found with the release coating coated trays. Overall, less than 10% of sludge was accumulated on coated tray surface as compared with those uncoated trays.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include ±1%, ±2%, ±3%, ±4%, ±5%, ±6%, ±7%, ±8%, ±9%, or ±10%, or more of the numerical value(s) being modified. In addition, the phrase "about 'x' to 'y'" includes "about 'x' to about 'y'".

Many variations and modifications may be made to the above-described embodiments. All such modifications and variations are intended to be included herein within the scope of this disclosure and protected by the following claims.

The invention claimed is:

1. A liquid electro-photographic (LEP) printer, comprising a structure having a repel coating disposed on a portion of the surface of the structure that contacts an ink formulation, wherein the repel coating is a highly fluorinated compound, wherein the ink formulation is a non-fluorinated ink formulation, and wherein the ink formulation does not substantially accumulate on the surface of the structure and wherein the highly fluorinated compound is selected from the group consisting of a perfluoropolyether (PFPE), a fluorinated epoxy, a fluorinated urethane, a fluorinated acrylic, and a combination thereof.

2. The LEP printer of claim 1, wherein the structure is a plastic structure.

3. The LEP printer of claim 1, wherein the structure is disposed in a binary ink development unit.

4. The LEP printer of claim 1, wherein the highly fluorinated compound is a perfluoropolyether (PFPE).

5. The LEP printer of claim 1, wherein the highly fluorinated compound is a fluorinated urethane.

6. A liquid electro-photographic (LEP) printer, comprising a structure having a release coating disposed on a portion of the surface of the structure that contacts an ink formulation, wherein the release coating is a fluorinated polyurethane, and wherein the ink formulation does not substantially accumulate on the surface of the structure.

7. The LEP printer of claim 6, wherein the structure is a plastic structure.

8. The LEP printer of claim 6, wherein the structure is disposed in a binary ink development unit.

9. The LEP printer of claim 6, wherein the fluorinated polyurethane is prepared from an aliphatic fluorinated polyol and an isocyanate.

10. The LEP printer of claim 9, wherein the aliphatic fluorinated polyol is selected from the group consisting of: a fluoroalkane alcohol, a fluoroether alcohol, a fluoro-sulfonamide alcohol, and a combination thereof.

11. The LEP printer of claim 9, wherein the isocyanate is selected from the group consisting of: 4,4'-methylene-bis-(cyclohexyl isocyanate), 1,4- cyclohexane diisocyanate, 1,3-cyclohexane diisocyanate, 1,4- butane diisocyanate, 1,6-hexane diisocyanate, 1,10-decane diisocyanate, 2,2,4-trimethyl-1,6-hexane diisocyanate, bis- (3- methyl-4-isocyanato-cyclohexyl) methane, 2,2-bis- (4-isocyanatocyclohexyl) propane, 3-isocyanatomethyl-3,5,5-trimethylcyclohexylisocyanate, 4,4'-dicyclohexyl diisocyanate, 2,4'-dicyclohexyl diisocyanate, and a combination thereof.

12. The LEP printer of claim 6, wherein the ink formulation includes a fluorinated material.

* * * * *

UNITED STATES PATENT AND TRADEMARK OFFICE

CERTIFICATE OF CORRECTION

PATENT NO. : 8,428,495 B2
APPLICATION NO. : 12/259582
DATED : April 23, 2013
INVENTOR(S) : Guang Jin Li It is certified that error appears in the above-identified patent and that said Letters Patent is hereby corrected as shown below:

On the Title page, in item (73), Assignee, in column 1, line 1, delete "Developent" and insert -- Development --, therefor.

In the Claims:

In column 12, line 37, in Claim 11, delete "1,4- cyclohexane" and insert -- 1,4-cyclohexane --, therefor.

In column 12, line 38, in Claim 11, delete "1,4- butane" and insert -- 1,4-butane --, therefor.

Signed and Sealed this
Twenty-fourth Day of September, 2013

Teresa Stanek Rea
*Deputy Director of the United States Patent and Trademark Office*